US005344502A

United States Patent [19]

Mack et al.

[11] Patent Number: 5,344,502

[45] Date of Patent: Sep. 6, 1994

[54] SURFACE HARDENED 300 SERIES STAINLESS STEEL

[75] Inventors: William C. Mack, Wadsworth; James M. Tanzosh, Silver Lake; Mark J. Topolski, Canton, all of Ohio

[73] Assignee: The Babcock & Wilcox Company, New Orleans, La.

[21] Appl. No.: 107,394

[22] Filed: Aug. 16, 1993

[51] Int. Cl.[5] ..... C21D 1/06

[52] U.S. Cl. ..... 148/236; 148/225

[58] Field of Search ..... 148/236, 225, 319

[56] References Cited

U.S. PATENT DOCUMENTS 1,432,416 10/1922 Rodman ..... 148/236

3,891,474 6/1975 Grange ..... 148/233

4,568,393 2/1986 Kane et al. ..... 148/236

FOREIGN PATENT DOCUMENTS 1654375 6/1991 U.S.S.R. ..... 148/326

*Primary Examiner*—Deborah Yee

*Attorney, Agent, or Firm*—Daniel S. Kalka; Robert J. Edwards

[57] ABSTRACT

The surface hardening diffusion process for an austenitic material such as 300-series stainless steel uses a pack carburization process at a temperature range from about 1500° F. to about 2500° F. for a period of time ranging from about one (1) to about eight (8) hours. Chromium carbides are formed on the surface of the austenitic material for increasing its wear resistance.

6 Claims, No Drawings

SURFACE HARDENED 300 SERIES STAINLESS STEEL

BACKGROUND OF THE INVENTION

1. Field of the Invention

The present invention relates in general to a carbon diffusion surface hardening process, and in particular to a pack carburization process for carburizing the surface of 300-series stainless steel.

2. Description of the Related Art

The use of surface hardening diffusion processes in increasing the wear resistance of metal alloys is well established and has been in commercial use for many years. Several common surface hardening diffusion processes in commercial use include pack carburizing, gas carburizing, carbo-nitriding, and nitriding. In these processes, carbon and/or nitrogen are diffused into the surface of the metal alloy.

Surface hardening is used to produce a hard wear-resistant surface without affecting the soft, tough, core properties of the alloy. This combination allows the maufacture of wear-resistant parts with good impact resistance. Generally, inexpensive low carbon low-alloy steels or ferritic stainless steels are used for producing surface hardened parts. These steels depend on the austenite to ferrite ($\gamma \rightarrow \alpha$) phase transformation and the carbon and/or nitrogen diffused into the surface for their wear resistance.

U.S. Reissue Pat. No. 29,881 describes a method of vacuum carburizing metal articles which include a sintered stainless steel. U.S. Pat. Nos. 4,533,403 and 4,495,006 describe methods for borocarburizing ferrous substrates. U.S. Pat. No. 4,495,005 describes a process for carbosiliconizing ferrous substrates. U.S. Pat. No. 4,539,053 describes a pack composition method for carburosiliconizing ferrous substrates.

The carburization of 300-series stainless steels is universally believed to be detrimental to the series corrosion properties. The formation of chromium carbides generally result in reduced corrosion properties under normal alloy usage conditions, though increases surface hardness.

Thus, there is a need for a surface hardening process for increasing the wear resistance of 300-series stainless steels, where the environment is not conducive to detrimental corrosive attack, but where other beneficial properties of austenitic stainless steels (eg. oxidation resistance, creep strength) may be used to advantage.

SUMMARY OF THE INVENTION

The present invention solves the aforementioned problems with the prior art as well as others by providing a carbon diffusion surface hardening process for increasing the wear resistance of 300-series stainless steels.

Advantageously, this series of stainless steels is austenitic ($\gamma$) in the wrought condition and does not undergo any austenite to ferrite ($\gamma$ to $\alpha$) phase transformations. The surface hardening procedure is achieved with creation of carbides on the surface. The higher concentration of carbides at the surface of the component increases its wear resistance.

One object of the present invention is to provide a pack carburizing method for surface hardening an austenitic workpiece.

Another object of the present invention is to provide a carbon diffusion surface hardening process for increasing the wear resistance of 300-series stainless steels by pack carburization.

The various features of novelty which characterize the invention are pointed out with particularity in the claims next to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENTS

The present invention resides in the use of a carbon diffusion surface hardening process to increase the wear resistance of an austenitic workpiece such as 300-series stainless steels. The term 300-series stainless steels is a term known in this art and refers to a range of materials including types 304, 310, 316, 309, 347, etc. The chemical compositions of these stainless steels are given in the 1993 *ANNUAL BOOK OF ASTM STANDARDS,* Vol. 01.01 Steel-Piping, Tubing, Fittings on pages 112 and 113. The 300-series stainless steels possesses excellent high temperature oxidation resistance and possesses good elevated temperature strength. This series of stainless steels is austenitic ($\gamma$) in the wrought condition and does not undergo any austenite to ferrite ($\gamma$ to $\alpha$) phase transformations. Surface hardening is achieved with the creation of carbides on or near the surface.

The present invention uses the pack carburization process to carburize the surface of 304 and 310 stainless steels. The pack carburizing treatment employs a temperature ranging between approximately 1500°–2500° F. and preferably 2050° F. (1121° C.) for a time ranging from one (1) to eight (8) hours and preferably for 5.5 hours. The process time and temperature are flexible in that a high enough temperature and a long enough time are required to achieve a reasonably deep higher hardness and higher concentration of carbides at the surface of the component. Even though a quench is not necessary in improving the wear resistance of 300-series stainless steel, it may be employed. With the pack carburization process of the present invention it has been found that a 58–73% increase in surface hardness over core hardness was achieved for 304SS and a 35–148% increase was achieved for 310SS.

It has further been found that the formation of chromium carbides in the austenitic material are not exceptionally detrimental to corrosion properties. In the intended environment, this does not create a corrosion problem. Normally, it is an aqueous environment that creates corrosion problems in a stainless steel that has excessive carbide precipitation. In this application, the carburized material is not used in aqueous application.

Table I lists the ASTM chemical requirements for types 304 and 310 stainless steel.

TABLE I

| | TP304 | TP310S |
|---|---|---|
| Carbon | 0.08 max | 0.08 max |
| Manganese, max | 2.00 | 2.00 |
| Phosphorus, max | 0.040 | 0.045 |
| Sulfur, max | 0.030 | 0.030 |
| Silicon | 0.75 max | 0.75 max |
| Nickel | 8.0–11.0 | 19.0–22.0 |
| Chromium | 18.0–20.0 | 24.00–26.00 |
| Molybdenum | — | 0.75 max |
| Titanium | — | — |
| Columbium + | — | — |

TABLE I-continued

| | TP304 | TP310S |
|---|---|---|
| tantalum | | |
| Tantalum, max | — | — |
| Nitrogen[c] | — | — |
| Cerium | — | — |
| Others | — | — |

EXAMPLE I

Coupons of 304SS and 310SS from bar stock were prepared so that they were 0.5 inches thick and 2 (two-)inches in diameter. These samples were loaded into a reaction vessel and filled with a carburizing pack. In this example the reaction vessel was only half-filled. The reaction vessel was subjected to a temperature of about 2050° F. (1121° C.) for 5.5 hours in a furnace with an inert gas environment. Following this carburization heat treatment, the reaction vessel was removed from the furnace and allowed to cool in air. Next, the stainless steel samples were cut, mounted, polished and etched with a chromic acid etchant. The samples were measured for Knoop hardness (100 gm) of carburized zone, intergranular, and core zone hardness.

The following table summarizes the microhardness results for this investigation:

| | Knoop Hardness (100 gms) | | |
|---|---|---|---|
| | Carburized Zone | Intergranular | Core |
| 304SS | 304–323 | 259–287 | 187–192 |
| 310SS | 215–384 | 184–279 | 155–159 |

The carburized zone of either 304SS and 310SS increased in hardness relative to the core of the sample. Additionally, an increase in hardness in an intergranular carbide zone (below the carburized region) was noted.

The following table summarizes the carbon diffusion zone thickness results of this example:

| | Diffusion Zone Thickness (mils) Measured On Down Side of Sample | |
|---|---|---|
| | Carburized Zone | Intergranular |
| 304SS | 2–5 | ≈16 |
| 310SS | 5–10 | ≈12 |

FIGS. 2 and 3 show the two carbide zones as well as the core of each sample. Both carburized samples showed erratic carburized zone thicknesses. However, it is believed that a uniform layer is obtainable.

The carburized zone on both 304SS and 310SS have increased in hardness relative to the core of the sample. An increase in hardness in the intergranular carbide zone (below the carburized region) was noted. The carburized 304SS exhibited a 2–5 mills carburized zone thickness with an underlying intergranular carbide zone thickness of approximately 16 mils. The carburized 310SS exhibited a 5–10 mils carburized zone thickness with an underlying intergranular carburized zone thickness of approximately 12 mils.

The use of the present invention described above provides the following advantages. There is an improved wear resistance of 300-series stainless steel components. This increases the service life of 300-series stainless steel components required to operate under certain wear environment. As a result, it reduces the down time of equipment dependent on 300-series stainless steel components required to operate under certain wear environments. As such there is a reduced need for expensive composite components for certain wear applications.

While pack carburizing was investigated for use in the carbon diffusion surface hardening of 300-series stainless steels, it is envisionable that other diffusion surface hardening processes may be employed such as gas, liquid, or vacuum carburizing , gas or liquid carbonitriding, and gas, salt, or iron nitriding may be employed.

While specific embodiments of the invention have been shown and described in detail to illustrate the application of the principles of the invention, it will be understood that the invention may be embodied otherwise without departing from such principles.

We claim:

1. A pack carburizing method for surface hardening an austenitic workpiece, comprising the steps of:

positioning the austenitic workpiece in a reaction vessel;

adding a carburizing pack to the reaction vessel;

subjecting the reaction vessel, carburizing pack and the austenitic workpiece to a temperature ranging from about 1500° F. to about 2500° F. for a time period ranging from about one (1) hour to about eight (8) hours; and forming chromium carbides on a surface of the austenitic workpiece to increase its wear resistance.

2. A method as recited in claim 1, wherein the austenitic workpiece is a 300-series stainless steel.

3. A method as recited in claim 2, wherein the temperature is about 2050° F.

4. A method as recited in claim 3, wherein the time period is about 5.5 hours.

5. A method as recited in claim 2, wherein the 300series stainless steel is a 304 stainless steel.

6. A method as recited in claim 2, wherein the 300series stainless steel is a 310 stainless steel.

* * * * *